US005508118A

United States Patent [19]

Hayashi et al.

[11] Patent Number: 5,508,118

[45] Date of Patent: Apr. 16, 1996

[54] ROTARY ANODE FOR X-RAY TUBE

[75] Inventors: Takehiko Hayashi; Shigehiko Takaoka, both of Toyama; Hisanori Ohara; Takashi Yoshioka, both of Itami, all of Japan

[73] Assignees: Tokyo Tungsten Co., Ltd., Tokyo; Sumitomo Electric Industries, Inc., Osaka, all of Japan

[21] Appl. No.: 245,460

[22] Filed: Jul. 6, 1993

[30] Foreign Application Priority Data

Jul. 3, 1992 [JP] Japan ..... 4-200253

[51] Int. Cl.[6] ..... H01J 35/10

[52] U.S. Cl. ..... 428/610; 378/144; 428/634; 428/665

[58] Field of Search ..... 428/655, 665, 428/635, 634, 636, 610; 378/144

[56] References Cited

U.S. PATENT DOCUMENTS

| | | | |
|---|---|---|---|
| 3,710,162 | 1/1973 | Bougle | 313/60 |
| 3,801,847 | 4/1974 | Dietz | 313/60 |
| 5,148,463 | 9/1992 | Woodruff et al. | 378/144 |

FOREIGN PATENT DOCUMENTS

| | | |
|---|---|---|
| 0062380 | 10/1982 | European Pat. Off. . |
| 0430766 | 6/1991 | European Pat. Off. . |
| 2153764 | 5/1973 | France . |
| 1173859 | 12/1969 | United Kingdom . |

*Primary Examiner*—John Zimmerman
*Assistant Examiner*—Linda L. Gray
*Attorney, Agent, or Firm*—Wenderoth, Lind & Ponack

[57] ABSTRACT

A long-life, inexpensive rotary anode for use in an X-ray tube having an X-ray generating layer formed by CVD on a graphite substrate and capable of producing high-power X-rays without the possibility of thermal cracks or delamination. When forming the X-ray generating layer of a tungsten-rhenium alloy on the graphite substrate through a rhenium intermediate layer by CVD, material gases are supplied intermittently so that the entire part or only the surface area of the X-ray generating layer will be formed of laminated structure of ultra-thin films each 0.1–5.0 microns thick. The content of rhenium in the tungsten-rhenium alloy forming the X-ray generating layer has a gradient form, i.e. increases from the interface with the rhenium intermediate layer toward the surface, so that the total amount of rhenium added can be reduced.

4 Claims, 3 Drawing Sheets

ROTARY ANODE FOR X-RAY TUBE

BACKGROUND OF THE INVENTION

1. Field of the Invention

The present invention relates to a rotary anode for use in a rotary anode type X-ray tube, and more specifically a rotary anode for use in an X-ray tube for which high output is required, such as a tomograph (hereinafter referred to as X-ray CT) used for medical diagnosis, and a method for manufacturing the same.

2. Description of the Related Art

Conventional rotary anodes for use in X-ray tubes are either made of tungsten only or of a laminated structure comprising tungsten and molybdenum. They are manufactured by the powder metallurgical process. When electron beams are applied to the surface of such an anode to produce X-rays, only 1% of the irradiation energy is converted into X-rays while the remaining 99% is converted to heat. Thus, its surface layer is likely to suffer thermal cracks due to thermal fatigue.

With recent rapid progress in the medical techniques, X-ray CT's are required to operate more accurately and reliably and produce high-power X-rays. Thus, the surface temperature of an anode used in such a CT can reach as high as about 3000° C. The temperature of the entire anode will reach about 1000° C. Thus, the anode tends to suffer thermal cracks due to severe thermal fatigue. This causes X-rays to be dispersed, causing a gradual reduction in the amount of X-rays produced.

There are two solutions to this problem. One is to increase the accumulated heat capacity to promote heat absorption and the other is to increase the revolving speed of the anode. But if the weight is increased to increase the heat capacity of a conventional anode, either formed of a single tungsten layer or having a laminated structure comprising tungsten and molybdenum layers, becomes impossible to increase its revolving speed. Thus, it was impossible to stably produce a high power required for X-ray CTs.

As a rotary anode which is free of these problems and which can produce high-power X-rays required for X-ray CTs, anodes have been proposed which comprise a substrate made of graphite, which is a material known to have a low specific gravity and a large heat capacity, and an X-ray generating layer provided on the graphite substrate and made of tungsten or its alloy. Among the methods for manufacturing such an anode, the chemical vapor deposition process (abbreviated to CVD) by which the X-ray generating layer is formed is considered most advantageous because with this method, the bond strength between the graphite substrate and the X-ray generating layer is stable.

Japanese Examined Patent Publication 47-8263 discloses a basic technique for forming an X-ray generating layer of a tungsten alloy by CVD in which a 0.1-mm-thick X-ray generating layer of a tungsten-rhenium alloy containing 1–35% by weight of rhenium is formed on a graphite substrate and in which an intermediate layer of rhenium is formed to attain a high adhesion between the tungsten-rhenium alloy layer and the graphite substrate. In other words, what is obtained is a structure comprising tungsten-rhenium alloy layer/rhenium intermediate layer/graphite substrate.

When a material gas of rhenium is supplied together with a material gas of tungsten, the rhenium serves, for its high reaction rate, as cores when the crystal grows. Thus, the metallographic structure of the tungsten-rhenium alloy layer becomes fine. Such fine structure shows increased strength and increased recrystallization temperature and thus is more resistant to thermal cracks. But since rhenium as the material gas is extremely expensive compared with tungsten, the above-mentioned technique, which provides a thick tungsten-rhenium alloy layer containing a large amount of rhenium, poses a problem that the rotary anode produced with this technique tends to be prohibitively expensive. Such anodes are therefore not used very widely.

In order to solve this problem, unexamined Japanese Patent Publication 63-228553 proposes a relatively low-cost double-layered X-ray generating layer comprising an ordinary columnar structure made only of tungsten and an overlying layer having a fine structure formed by adding rhenium to tungsten. Namely, the X-ray generating layer obtained with this technique has a structure comprising, from its outer side, tungsten-rhenium alloy layer having a fine structure/tungsten layer having a columnar structure/rhenium intermediate layer/graphite substrate.

But this rotary anode has a problem in that there are points where the distribution of rhenium is discontinued in the X-ray generating layer. Moreover, because of the difference in thermal expansion coefficient between tungsten and rhenium (the thermal expansion coefficient of the former is $4.6\times10^{-6}k^{-1}$ whereas that of the latter is $6.7\times10^{6}k^{-1}$), peeling tends to occur at the discontinuous points in the rhenium composition, i.e. at the interface between the tungsten-rhenium alloy layer and the tungsten layer.

On the other hand, U.S. Pat. No. 4,920,012 discloses another method for providing an X-ray generating layer having a fine metallographic structure. With this method, the feed rate gradient of the material gas in the CVD process is set at 105 cm/cm.sec or higher to form an X-ray generating layer having an equi-axed metallographic structure having an average crystal grain diameter of 0.04– 1 μ m. Namely, this X ray generating layer has a structure comprising, from its outer surface, tungsten or tungsten-rhenium alloy layer having a fine equi-axed structure/rhenium intermediate layer/graphite substrate.

This technique makes it possible to provide an X-ray generating layer having a fine structure without adding rhenium. But with this method, the structure tends to grow in a branch-like manner. The film thus obtained is low in mechanical strength and the X-ray generating layer is relatively brittle, so that it is more likely to suffer thermal cracks, which may extend deep into the X-ray generating layer.

SUMMARY OF THE INVENTION

An object of the present invention is to provide a long-life inexpensive rotary anode for use in an X-ray tube which has an X-ray generating layer formed on a graphite substrate by CVD and which is free of thermal cracks and delamination and which can produce high-power X-rays stably.

According to the present invention, there is provided a rotary anode for use in an X-ray tube comprising a graphite substrate and an X-ray generating layer made of a tungsten-rhenium alloy and provided on the graphite substrate through an intermediate layer of rhenium, the X-ray generating layer having at least its surface portion formed of a plurality of ultra-thin films of a tungsten-rhenium alloy each 0.1–5.0 μm thick and laminated one upon another.

According to the present invention, the X-ray generating layer in the rotary anode for use in an X-ray tube is produced by intermittently supplying material gases onto a film-forming surface of the rhenium intermediate layer when forming an X-ray generating layer of tungsten-rhenium alloy by a chemical vapor deposition process (CVD) on the intermediate layer of rhenium provided on the graphite substrate.

According to the present invention, the content of rhenium in the tungsten-rhenium alloy forming the X-ray generating layer should increase gradually from the interface with the rhenium intermediate layer toward the surface. Such a gradient composition can be attained by increasing the content of rhenium gas in the material gas in every intermittent supply of material gases or in every plurality of supplies.

DETAILED DESCRIPTION OF THE INVENTION

By adding rhenium to tungsten forming an X-ray generating layer, the metallographic structure becomes fine and the recrystallization temperature rises, so that the X-ray generating layer is less likely to suffer thermal cracks. According to the present invention, the X-ray generating layer has an ultra-thin laminated structure. By laminating such ultra-thin films on the surface of the rhenium intermediate layer on the graphite substrate, the formation of thermal cracks in the X-ray generating layer can be restrained and thermal cracks, if any, will appear only in a very shallow area near the surface to be irradiated with electron beams and never reach deep into the X-ray generating layer.

By laminating ultra-thin films of a tungsten-rhenium alloy, grain boundaries of the metallographic structure are formed between the adjacent ultra-fine films. The X-ray generating layer may be formed in such a way that the grain boundaries are arranged normal to the direction in which electron beams are emitted. Namely they are formed so that the ultra-thin films grow by lamination in the same direction as the direction in which electron beams are emitted. Otherwise, after forming the X-ray generating layers, the rotary anode may be positioned so that the direction in which the ultra-thin films grow by lamination will coincide with the direction in which electron beams are emitted, i.e. in such a way that the surfaces of the ultra-thin films extend normal to the direction in which electron beams are emitted. In this way, thermal cracks can be prevented most effectively.

In order to reduce thermal cracks and to restrain X-rays from scattering, the thickness of each ultra-thin film of a tungsten-rhenium alloy should be 0.1–5.0 μm, preferably 0.1–1.0 μm. If thinner than 0.1 μm, the film formed by laminating ultra-thin films will be insufficient in mechanical strength. If over 5.0 μm, it is difficult to reduce thermal cracks.

Such a laminated structure comprising ultra-thin films of a tungsten-rhenium alloy may be formed only in the superficial area of the X-ray generating layer where thermal loads are the harshest. But if the X-ray generating layer is thin and thus the entire layer is subjected to severe thermal loads, the entire X-ray generating layer should preferably be formed of the laminated structure comprising ultra-fine films.

The greater the product of the radiation energy of electron beams (acceleration voltage x current) and the irradiation time (in second), or the smaller the heat capacity of the entire anode, the greater the thickness of the entire X-ray generating layer has to be. Ordinarily, the thickness should be determined within the range of 300–1000 μm. How deeply the laminated structure of ultra-thin films should be formed in the X-ray generating layer having the above-defined thickness may be determined taking into account the depth of thermal cracks formed in conventional articles or determined so that the stress and temperature inferred from thermal stress calculation or heat transfer calculation by e.g. the finite element method will not exceed the breaking strength and the recrystallization temperature of the tungsten-rhenium alloy.

For example, as a result of examination of some conventional articles, it has turned out that thermal cracks extend to the depth of about 200 μm. Thus, provided the thickness of the entire X-ray generating layer is 500 μm, thermal cracks can be prevented if the laminated structure of ultra-thin films is formed to the depth of 200–250 μm from the surface of the X-ray generating layer. But, if the thickness of the entire X-ray generating layer is 300 μm, the entire layer should preferably be formed of the laminated structure.

On the other hand, though we would refrain from discussing the details of heat transfer calculation, it is possible to estimate the thermal transfer in a simple manner using the following equations. First, let us consider the heat transfer in a non-isothermal system in the primary direction (direction of depth). Temperature T at depth x from the surface is represented by the following equation (1).

$$T=T_O+(x/L)\times(T_L-T_O) \quad (1)$$

wherein $T_O$ and $T_L$ are temperatures at the surface (x=0) and at the depth L from the surface (x=L), respectively. These values are considered to be constant in a stationary state. Thus, the equation (1) can be rewritten into the following equation (2).

$$T=a+bx \text{ (a and b are constants)} \quad (2)$$

This equation suggests that the temperature distribution in the direction of depth can be expressed by a linear function.

Now, let us consider a rotary anode for an X-ray tube. In the equation (1), it is presumed that the surface temperature $T_O$ of the X-ray generating layer is 3000° C. and the temperature $T_L$ of the graphite substrate is 1000° C. Thus, provided the thickness of the X-ray generating layer is L, the equation (1) can be rewritten into the following equation (3).

$$T=3000-2000\ (x/L) \quad (3)$$

Namely, this suggests that the temperature distribution in the X-ray generating layer decreases monotonously inwardly from the surface as a linear function. In order to reduce thermal cracks in the X-ray generating layer under such temperature conditions, which are inferred from heat transfer calculations, only part of the X-ray generating layer where the temperature exceeds the recrystallization temperature of tungsten, i.e. 1600° C. may be formed of the laminated structure of ultra-thin films and rhenium may be added only to this part to increase the recrystallization temperature.

But if rhenium is added only to a portion of the X-ray generating layer, the metallographic structure of this portion will become fine, so that there will appear discontinuity in metallographic structure between the portion to which rhenium is added and the remaining portion. The X-ray generating layer may suffer delamination at the interface. Thus, according to the present invention, rhenium should be added to the entire X-ray generating layer.

In order to avoid this problem, according to the present invention, the entire X-ray generating layer is formed of a tungusten-rhenium alloy and either the entire part of the X-ray generating layer or only its surface portion may be formed of the laminated structure of ultra-fine films.

The content of rhenium in the tungsten-rhenium alloy should be preferably within the range of 0.5–10 atomic percent. Because of a large difference in thermal expansion coefficient between rhenium and tungsten, if the content of rhenium in the X-ray generating layer is too low, delamination may occur in the rhenium intermediate layer due to thermal shock when X-rays are produced. In order to prevent such delamination, the content of rhenium has to be at least 0.5 atomic percent.

If the rhenium content is less than 0.5 atomic percent, the ductility of the film will be insufficient and also the recrystallization temperature will be so low that the resistance to thermal cracks will be insufficient. Even if the rhenium content exceeds 10 atomic percent, the ductility and thermal crack resistance will not improve any further. The material cost will increase with increase in the amount of expensive rhenium.

Further, according to the present invention, the content of rhenium in the tungsten-rhenium alloy forming the X-ray generating layer should gradually increase within the range of 0.5–10 atomic percent, from inside of the layer toward its surface at the same rate as the temperature gradient which is expressed by equation (3), which is a linear function. This makes it possible to minimize thermal cracks in the X-ray generating layer and produce a delamination-free continuous metallographic structure while keeping the amount of expensive rhenium to a minimum.

The content of rhenium in the tungsten-rhenium alloy should be 3–10 atomic percent near the surface where the recrystallization temperature has to be high because the surface temperature is high as will be apparent from the above-mentioned temperature distribution. It should be 0.5–2 atomic percent at the interface with the rhenium intermediate layer where the temperature is lower than in the surface portion. If the content of rhenium in the surface portion is less than 3 atomic percent, it will be difficult to sufficiently increase the recrystallization temperature and the ductility and to form a sufficiently fine structure. Thus, even if the laminated structure of ultra-thin films is formed, it would be difficult to sufficiently reduce thermal cracks. On the other hand, at the interface with the rhenium intermediate layer, it is not necessary and undesirable from the economical viewpoint to add rhenium in the amount exceeding 2 atomic percent.

Also, as described above, thermal cracks usually extend to the depth of 200 μm in a conventional X-ray generating layer made of a tungsten-rhenium alloy containing a predetermined amount of rhenium. Thus, it is necessary to further increase the recrystallization temperature and to form a finer structure by increasing the rhenium content in this region. More specifically, the rhenium content in the region from the surface to the depth of 200–300 μm should preferably be 3–10 atomic percent.

FIG. 3 shows rhenium distribution curves in the tungsten-rhenium alloy as the X-ray generating layer which satisfy the above-discussed various limitations. Curve (b) shows a rhenium distribution which increases linearly and continuously from the interface with the rhenium intermediate layer (depth from the surface x=L) to the surface (x=0). It is, however, not necessary that the rhenium content increase linearly. There may be a region or regions where the rhenium content is constant (like curve (a)), provided a necessary minimum amount of rhenium is contained in the interface and the surface portion and the rhenium content increases gradually from the interface toward the surface.

The X-ray generating layer has the laminated structure of ultra-thin films in its entire part or only in the surface region. But this does not mean that the laminated structure of ultra-thin films has to be always associated with the rhenium content gradient. From an industrial viewpoint, however, it is preferable that the rhenium content in every or every several adjacent ultra-thin films in the laminated structure be greater or smaller than the adjacent one or ones so that microscopically, the rhenium content will rise in steps in one direction as shown by the enlarged view in FIG. 3.

Next, we will describe a method of forming the X-ray generating layer in the rotary anode for an X-ray tube according to the present invention. It is known to form an X-ray generating layer from a tungsten-rhenium alloy by CVD. Among CVD process, the process of reducing a metallic fluoride with hydrogen is the most generally practiced method because the film-forming temperature is low and the crystal structure can be controlled with relative ease.

The following reaction formulas represent the reactions in which tungsten and rhenium fluorides are reduced with hydrogen.

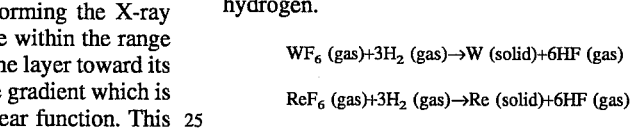

$$WF_6\ (gas)+3H_2\ (gas)\rightarrow W\ (solid)+6HF\ (gas)$$

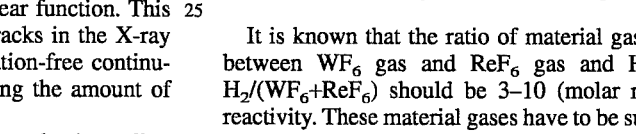

$$ReF_6\ (gas)+3H_2\ (gas)\rightarrow Re\ (solid)+6HF\ (gas)$$

It is known that the ratio of material gases, i.e. the ratio between $WF_6$ gas and $ReF_6$ gas and $H_2$ gas, that is, $H_2/(WF_6+ReF_6)$ should be 3–10 (molar ratio) for higher reactivity. These material gases have to be sufficiently mixed together before being fed into the reaction chamber.

According to the method of the present invention, the mixed material gases should be supplied intermittently to form the laminated structure of ultra-thin films. Namely, the material gases, intermittently supplied onto the film-forming surface of the substrate, collide with the heated surface and receive the heat energy. A metal thus deposits on the film-forming surface by the reaction represented by the above reaction formulas. This process takes place substantially at the moment of collision. Thus, the moment the supply of material gases stops, the film will stop growing. When the supply of material gases is resumed, another crystal growth will take place. In this way, ultra-thin films of tungsten-rhenium alloy having a laminated structure are formed. Between the ultra-thin films are formed grain boundaries having a metallographic structure.

Methods of intermittently supplying the material gases include opening and closing a gas supply valve or opening and closing a shutter provided between the gas supply nozzle and the substrate. Any method may be employed as far as it allows intermittent supply of material gases to the film-forming portion on the substrate surface. The thickness of the ultra-thin films can be controlled by adjusting the frequency of intermittent supply of material gases and the temperature, pressure, etc. during the film-forming step.

In order to attain a gradient content of rhenium in the tungsten-rhenium alloy in the X-ray generating layer, the rate of rhenium material gas in the material gases, namely ratio $ReF_6/(WF_6+ReF_6)$, may be increased gradually. Especially if it is necessary to increase the rhenium content in steps according to the laminated ultra-thin films to be obtained, the ratio $ReF_6/(WF_6+ReF_6)$ may be increased in every intermittent supply of material gases or in every plurality of supplies.

It is preferable that the pressure in the reaction chamber for forming films by CVD be 0.2–50 Torr and the ratio of the gas pressure (Vi) in the material gas supply nozzle to the gas pressure (Vo) outside the nozzle, i.e. the ratio (Vi/Vo), be equal to or higher than 1.5. By setting the ratio (Vi/Vo) at 1.5 or greater, it is presumed that the material gases discharged from the supply nozzle are subjected to adiabatic expansion and collide with the film-forming surface in a clustered state. This makes it possible to form fine crystal grains and improve the reaction efficiency of material gases. If the pressure in the reaction chamber is lower than 0.2 Torr, the gas flow velocity will be so high that the reaction efficiency will drop. If higher than 50 Torr, it is difficult to increase the pressure ratio to 1.5 or higher.

According to the present invention, in a rotary anode for use in an X-ray tube, the X-ray generating layer of a tungsten-rhenium alloy has a laminated structure of ultra-thin films. Such an X-ray generating layer is less likely to suffer from thermal cracks, reduction in X-ray dosage or delamination. This makes it possible to produce long-life rotary anodes at low cost.

Furthermore, since the tungsten-rhenium alloy forming the X-ray generating layer has a rhenium content gradient corresponding to the temperature gradient when X-rays are generated, the total amount of rhenium contained in the X-ray generating layer can be reduced markedly without lowering the effect of restraining thermal cracks. This leads to a considerable cutdown in the production cost of rotary anodes.

BRIEF DESCRIPTION OF THE DRAWINGS

Other features and objects of the present invention will become apparent from the following description made with reference to the accompanying drawings, in which.

DESCRIPTION OF THE PREFERRED EMBODIMENTS

Embodiment 1

A 30 μm-thick rhenium intermediate layer was formed on a graphite substrate by the CVD process using a known process in which $ReF_6$ is reduced with hydrogen. On the rhenium intermediate layer was formed a 500 μm-thick tungsten-rhenium alloy layer as an X-ray generating layer by the CVD process utilizing the hydrogen reducing process, using $WF_6$ and $ReF_6$ as material gases which were mixed together at the molar ratio of 95:5.

The mixed material gases were supplied into the reaction chamber intermittently at a frequency of intermittent supplies being 6 seconds. The flow rate of $H_2$ gas was 6 times the flow rate of the combined gas of $WF_6$ and $ReF_6$. The pressure in the reaction chamber was set at 20 Torr, while the pressure ratio (Vi/Vo) between inside and outside the material gas supply nozzle was set to 2.0 and the temperature of substrate was set at 700° C.

Figure 1:
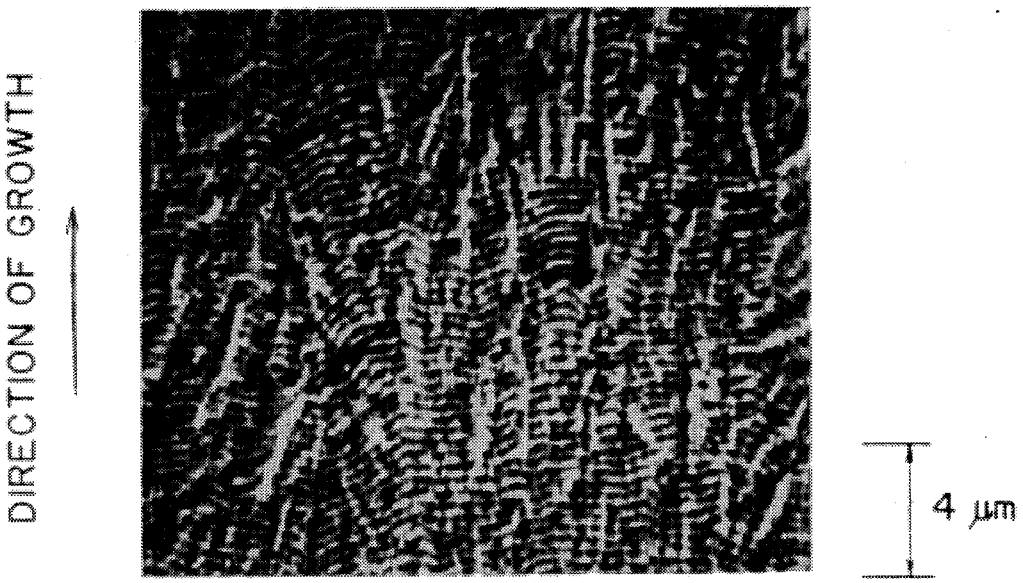
FIG. 1 is an electron microphotograph (×4000) showing the metallographic structure of the section of the X-ray generating layer having a laminated structure of ultra-thin films of a tungsten-rhenium alloy according to the present invention.

After grinding and etching the section of the tungsten-rhenium alloy layer, it was observed through a scanning electron microscope. It was confirmed that a laminated structure of ultra-thin films each 0.4 μm thick was formed as shown in FIG. 1.

For comparison purposes, a 500 μm-thick tungsten-rhenium alloy layer was formed by supplying material gases continuously instead of intermittently with the other forming conditions unchanged. We observed the section of the tungsten-rhenium alloy layer thus obtained in the same manner as above. We found only an ordinary columnar structure. No laminated structure of ultra-fine films was observed.

Embodiment 2

We prepared five kinds of rotary anodes in the same manner as in Embodiment 1, with different thicknesses of the ultra-thin films of the tungsten-rheniumalloy as the X-ray generating layer within the range of 0.1–5.0 μm. They were subjected to a thermal heat fatigue test in which they were heated by electron beams. The entire X-ray generating layers had a thickness of 500 μm in any rotary anodes.

As comparative examples, we prepared a specimen in which each of the ultra-fine films of tungsten-rhenium alloy had a thickness outside the above range, a specimen in which the tungsten-rhenium alloy had an ordinary columnar metallographic structure (the columnar crystal grains having a diameter of 30 μm), and a specimen having a fine equiaxed structure (average crystal grain diameter being 0.5 μm) which was formed by supplying material gases with a large supply velocity gradient.

The thermal fatigue test was conducted by using a 5 kW electron gun, the area to be irradiated with electron beams being 10 mm in diameter (78 $mm^2$). Each electron beam irradiation time was 2 seconds. Other conditions were adjusted so that the temperature will change within the heat cycle of 500° to 2000° C. The results obtained are shown in Table 1.

Table 1 shows that the specimens according to the present invention suffered neither thermal cracks nor delamination in the 10000-cycle thermal cycle test, whereas the other comparative specimens suffered thermal cracks at 2000 or 5000 cycles and thus the specimens according to the present invention show much higher resistance to thermal cracks.

Embodiment 3

We prepared three kinds of rotary anodes in the same manner as in Embodiment 1, with different thicknesses of the ultra-thin films of the tungsten-rhenium alloy as the X-ray generating layer of 0.1 μm, 0.5 μm and 2.0 μm and the rhenium content being a gradient. The three kinds of rotary anodes thus obtained were subjected to a thermal fatigue test in which they were heated by electron beams in the same way as in Embodiment 2. The results are shown in Table 2.

Figure 3:
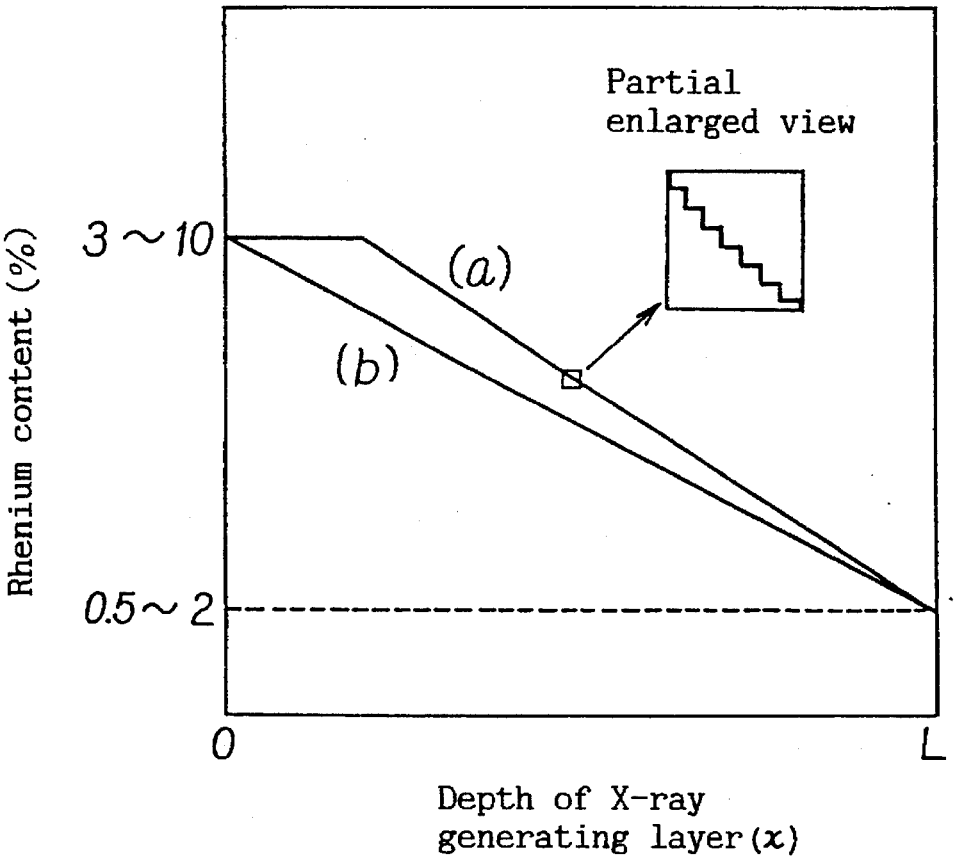
Figure 3A:
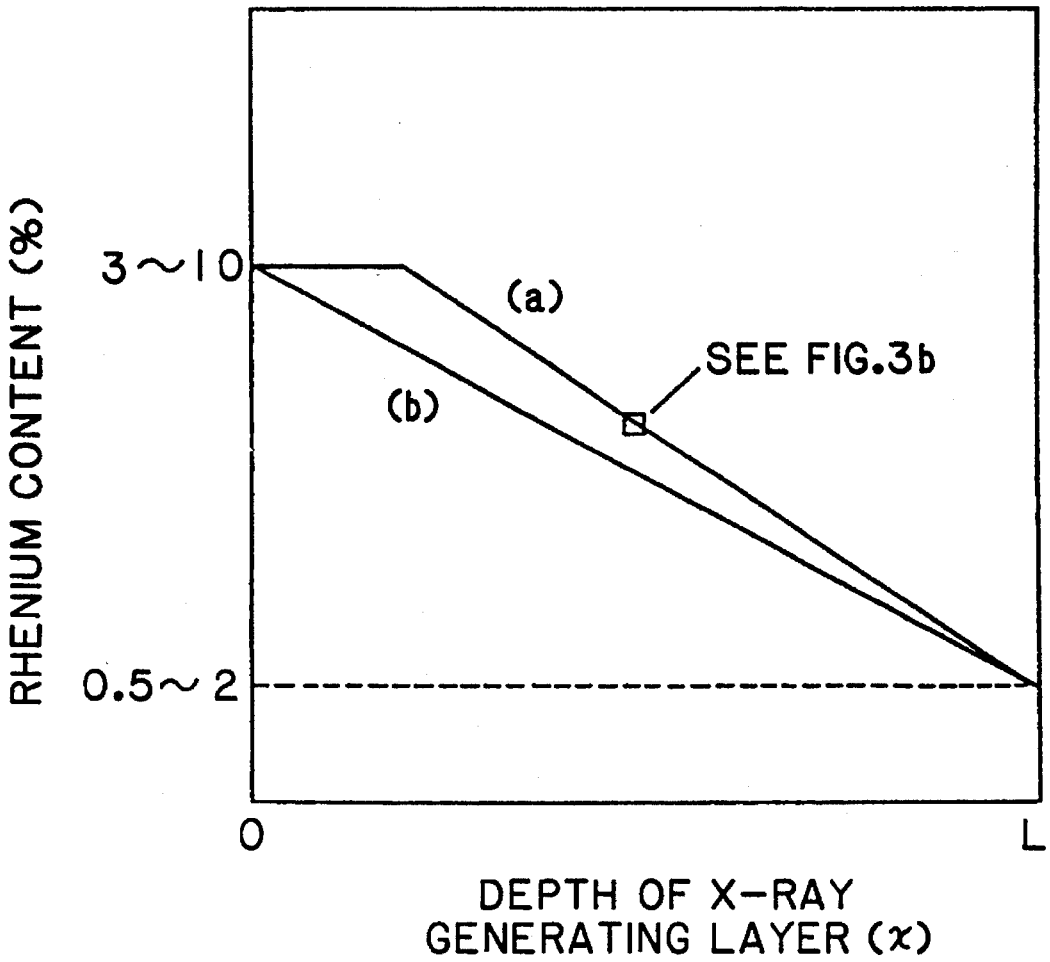
Figure 3B:
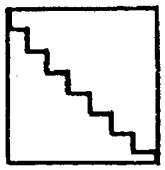

In order that the rhenium content may have a gradient form, since the forming speed of the tungsten-rhenium alloy was 250 μm per hour, at the beginning of film-forming step, the ratio of material gases $ReF_6/(WF_6+ReF_6)$ was set at 1%, increased gradually until it reached 5% one hour later and kept at 5% thereafter. An X-ray generating layer (500 m in thickness) having the rhenium content distribution as represented by curve a) in FIG. 3 was thus formed.

These specimens, in which the rhenium content was controlled to have a gradient form, showed thermal crack resistance comparable to that of the specimens of Embodiment 2 of the present invention, in which the rhenium content is constant, in spite of the fact that the rhenium content in the specimens of Embodiment 3 was 20% smaller in total amount than that in the specimens of Embodiment 2.

Embodiment 4

On graphite substrates provided on their respective surfaces with 30-micron-thick rhenium intermediate layers were formed, respectively, an X-ray generating layer having a laminated structure of ultra-thin films in which the rhenium content is constant (same as Specimen 2 of the present invention shown in Table 1) and an X-ray generating layer having a laminated structure of ultra-thin films in which the rhenium content has a gradient form (same as Specimen 7 of the present invention shown in Table 2), under the same conditions that the 0.5-micron-thick ultra-thin films of tungsten-rhenum alloy were formed in Embodiments 2 and 3.

A life test was conducted on X-ray tubes using the rotary anodes thus obtained. For comparison purposes, a similar life test was conducted on a specimen in which the tungsten-rhenium alloy had a columnar metallographic structure (average crystal grain diameter being 50 μm; same as Comparative Specimen 2 in Table 1), and a specimen having a fine equiaxed structure (average crystal grain diameter being 0.5 μm; same as Comparative Specimen 3 in Table 1).

In the life evaluation test, the specimens were irradiated with electron beams having the constant output level of 400 mA at 120 kV, the same level as electron beams used in actual clinical X-ray CT's. The life of each specimen was calculated by comparing the rates of reduction in the X-ray dosage when a predetermined number of X-ray photos were taken. The results obtained are shown in FIG. 2.

Figure 2:
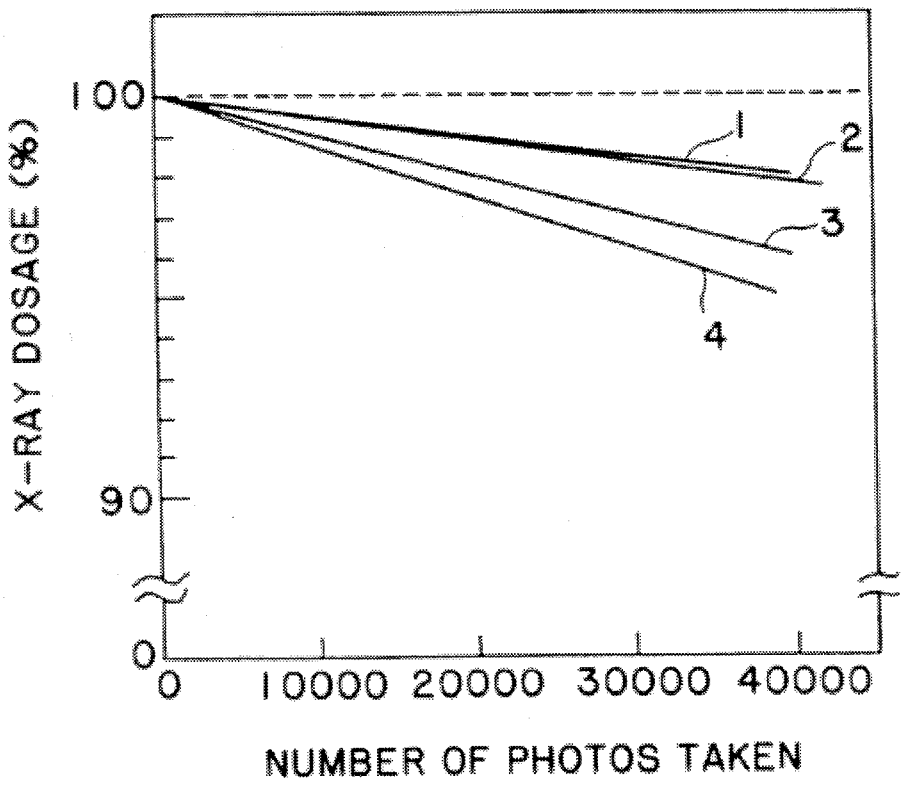
FIG. 2 is a graph showing how the X-ray dosage of each rotary anode decreases in the life evaluation test and FIG. 3 is a graph showing a typical gradient rhenium content in the X-ray generating layer of a tunsten-rhenium alloy according to the present invention.

As shown in FIG. 2, with Specimen 2 of the present invention (line 1 in FIG. 2) and Specimen 7 of the present invention (line 2 in FIG. 2), the reduction rates in X-ray dosage when 40000 photos were taken were only about 2%, whereas with the comparative specimen having an equiaxed structure (line 3 in FIG. 2) and the specimen having a columnar structure (line 4 n FIG. 2), the reduction rates were about 4% and about 5%, respectively. This clearly shows that the specimens of the present invention have longer lives.

It is especially notable that Specimen 7 of the present invention (line 2 in FIG. 2), having a gradient rhenium content, showed a long life comparable to Specimen 2 of the present invention (line 1 in FIG. 2) in which the rhenium content is constant, in spite of the fact that the total rhenium content in Specimen 7 was about 20% lower than that of Specimen 2 of the present invention (line 1 in FIG. 2) in which the rhenium content is also constant.

TABLE 1

| Specimen | Structure of W-Re alloy layer | Thermal crack not observed? (cycle) 1000 | 2000 | 5000 | 10000 |
|---|---|---|---|---|---|
| Specimen No. 1 | Laminated structure of ultra-thin films (0.1 μm) | O | O | O | O |
| Specimen No. 2 | Laminated structure of ultra-thin films (0.5 μm) | O | O | O | O |
| Specimen No. 3 | Laminated structure of ultra-thin films (1.0 μm) | O | O | O | O |
| Specimen No. 4 | Laminated structure of ultra-thin films (2.0 μm) | O | O | O | O |
| Specimen No. 5 | Laminated structure of ultra-thin films (5.0 μm) | O | O | X | X |
| Comparative Example No. 1 | Laminated structure of ultra-thin films (0.05 μm) | O | O | O | X |
| Comparative Example No. 2 | Laminated structure of ultra-thin films (10.0 μm) | O | X | X | X |
| Comparative Example No. 3 | Columnar Structure (diameter 30 μm) | O | X | X | X |
| Comparative Example No. 4 | Fine equiaxed structure (grain diameter 0.5 μm) | O | X | X | X |

TABLE 2

| Specimen | Structure of W-Re alloy layer | Thermal crack not observed? (cycle) 1000 | 2000 | 5000 | 10000 |
|---|---|---|---|---|---|
| Specimen No. 6 | Laminated structure of ultra-thin films (0.1 μm) + Re gradient | O | O | O | O |
| Specimen No. 7 | Laminated structure of ultra-thin films (0.5 μm) + Re gradient | O | O | O | O |
| Specimen No. 8 | Laminated structure of ultra-thin films (2.0 μm) + Re gradient | O | O | O | O |

What is claimed is:

1. A rotary anode for use in an X-ray tube comprising a graphite substrate and an X-ray generating layer made of a tungsten-rhenium alloy and provided on said graphite substrate through an intermediate layer of rhenium, said X-ray generating layer having at least its surface portion formed of a plurality of ultra-thin films of a tungsten-rhenium alloy each 0.1–5.0 μm thick and laminated one upon another, wherein the content of rhenium in the tungsten-rhenium alloy forming said X-ray generating layer increases gradually from an interface with said intermediate layer toward the surface portion of said X-ray generating layer.

2. A rotary anode for use in an X-ray tube as claimed in claim 1 wherein the content of rheniumin in the tungsten-rhenium alloy forming said X-ray generating layer is 0.5–10 atomic percent.

3. A rotary anode for use in an X-ray tube as claimed in claim 1 wherein the content of rhenium in the tungsten-rhenium alloy is 0.5 atomic percent at the interface with said intermediate layer and 3–10 atomic percent at the surface portion of said X-ray generating layer.

4. A rotary anode for use in an X-ray tube as claimed in claim 3 wherein a region where said laminated ultra-thin films of tungsten-rhenium alloy are present and/or a region where the content of rhenium in the tungsten-rhenium alloy is 3–10 atomic percent extends to a depth of 200–300 μm from the surface of said X-ray generating layer.

* * * * *